US007370496B1

(12) United States Patent
Shai

(10) Patent No.: US 7,370,496 B1
(45) Date of Patent: May 13, 2008

(54) MULTI-USE PORTABLE LOCK SYSTEM

(75) Inventor: Moti Shai, 3524 Viadel Prado, Calabasas, CA (US) 91302

(73) Assignee: Moti Shai, Studio City, CA (US)

( * ) Notice: Subject to any disclaimer, the term of this patent is extended or adjusted under 35 U.S.C. 154(b) by 198 days.

(21) Appl. No.: 10/893,784

(22) Filed: Jul. 19, 2004

(51) Int. Cl.
*E05B 73/00* (2006.01)

(52) U.S. Cl. ..... 70/14; 70/30; 70/49; 70/58; 70/158

(58) Field of Classification Search ..... 70/14–19
See application file for complete search history.

(56) References Cited

U.S. PATENT DOCUMENTS 2,472,022 A * 5/1949 Neal ..... 269/157
2,947,333 A * 8/1960 Johnson ..... 269/170
3,053,302 A * 9/1962 Bopst, III ..... 152/226
3,664,164 A * 5/1972 Zaidener ..... 70/202
4,003,227 A * 1/1977 Casey ..... 70/14
4,057,239 A * 11/1977 Hopf et al. ..... 269/170
4,669,934 A * 6/1987 Wisecarver ..... 410/151
4,819,462 A * 4/1989 Apsell ..... 70/14
4,958,867 A * 9/1990 Champagne ..... 292/259 R
5,217,213 A * 6/1993 Lii ..... 269/6
5,284,036 A * 2/1994 Rosenbaum ..... 70/14
5,333,477 A * 8/1994 Davis ..... 70/226
5,369,970 A * 12/1994 Voiculescu et al. ..... 70/240
5,437,171 A * 8/1995 Owen ..... 70/14
5,568,916 A * 10/1996 Gibbons et al. ..... 269/174
5,626,263 A * 5/1997 Lii ..... 222/192
5,709,372 A * 1/1998 Lii ..... 269/6
5,732,936 A * 3/1998 Lii ..... 269/6
5,996,736 A * 12/1999 Stankiewicz ..... 182/127
6,058,749 A * 5/2000 Rekemeyer ..... 70/226
6,109,076 A * 8/2000 Kajuch ..... 70/209
6,237,375 B1 * 5/2001 Wymer ..... 70/14
6,575,001 B1 * 6/2003 Simon et al. ..... 70/202
6,578,395 B2 * 6/2003 Takerian et al. ..... 70/261
6,896,232 B2 * 5/2005 Crowell et al. ..... 248/316.4
6,983,629 B1 * 1/2006 Gogel ..... 70/14

* cited by examiner

*Primary Examiner*—Suzanne Dino Barrett

(57) ABSTRACT

A multi-use portable lock system is provided. The system enables a user to secure valuable personal particles placed on top of the desk, like a keyboard, phone, answering machine, notebook and the like, without prior preparations and without damaging the desk. The system also enables the user to lock the doors of closets, kitchen cabinets, washer and dryer machines and the like. The system can be secured by a lock and key, and also includes foldable capabilities for storage and traveling purposes.

1 Claim, 6 Drawing Sheets

MULTI-USE PORTABLE LOCK SYSTEM

BACKGROUND OF THE INVENTION

1. Field of the Invention

The present invention relates generally to improvement for devices enabling a user to lock valuable portable particles placed temporarily on the desk. The current invention also provides an ability to lock doors such as bedroom doors, closet sliding doors, kitchen cabinet doors, washer and dryer doors and the like. In an embodiment, the present invention is foldable for storage and traveling purposes.

2. Description of the Related Art

Travelers and temporary residents frequently require multi purpose portable temporary lock to secure valuable particles placed on or inside exiting furniture like the top of the desk, doors, drawers and the like. A lock that has the ability to be foldable and portable, does not require any installation preparation, or any furniture change and does not leave any marks after removed, is needed in the art.

Inventors have created several types of locks, but all of them require professional personnel to install it and it is not removable without leaving damage. Different and additional locks require locking different parts of furniture.

The systems and methods of the present invention are particularly useful for people that find the need to lock an item like laptop, keyboard, answering machine, or even written documents, etc. on the desk.

In another embodiments the invention enables the user to lock a washer & dryer at a laundry-mat to protect their belongings; it can lock cabinet doors, sliding closet doors, and bedroom doors from room-mates and others. The system does not cause any damage to the furniture while providing fast and safe lock to almost anything. Conventional locks, today on the market, require professional personnel to install it and it doesn't have all the capabilities that the current invention has.

Still further objects and advantages will become apparent from consideration of the ensuing description and drawings.

SUMMARY OF THE INVENTION

Briefly and in general terms, the present invention provides a new and improved system and method for providing a user foldable and portable multi-use lock system to secure valuable particles placed on top of a desk, like a computer keyboard, answering machine, phone, notebook and the like as well as locking doors of closets, kitchen cabinets, drawer, washer and dryer machines and the like.

More particularly, in an embodiment of the present invention, multi-use portable lock system is provided for enabling a user to secure valuables temporarily placed on top of the desk, without prior preparation and any damage to the surface. In one embodiment, the system includes an adjusting assembly, with a adjustable string and interior base plate, by placing the adjusting assembly inside, and the lock system, outside of a pair of doors, the adjusting string connected between them can be adjusted, and thus holds the pair of doors very tight, allowing the system to be key locked.

DETAILED DESCRIPTION OF THE PREFERRED EMBODIMENTS

The present invention is directed to an improved system and method for providing a user a portable multi-use lock enabling the user to lock temporarily placed valuable particles on the desk and to lock doors of a closet, kitchen cabinets and the like. The system is easy and convenient to fold up for portability and storage purposes. The preferred embodiments of the improved system and method are fully and detailed illustrated and described in the following paragraphs.

The invention provides for efficient locking of temporarily placed valuable items on a desk as well as enabling a user to lock doors such as closet doors, kitchen cabinets doors, washing and drying machines doors and the like, constituting a Multi-use Portable Lock System.

Figure 1:
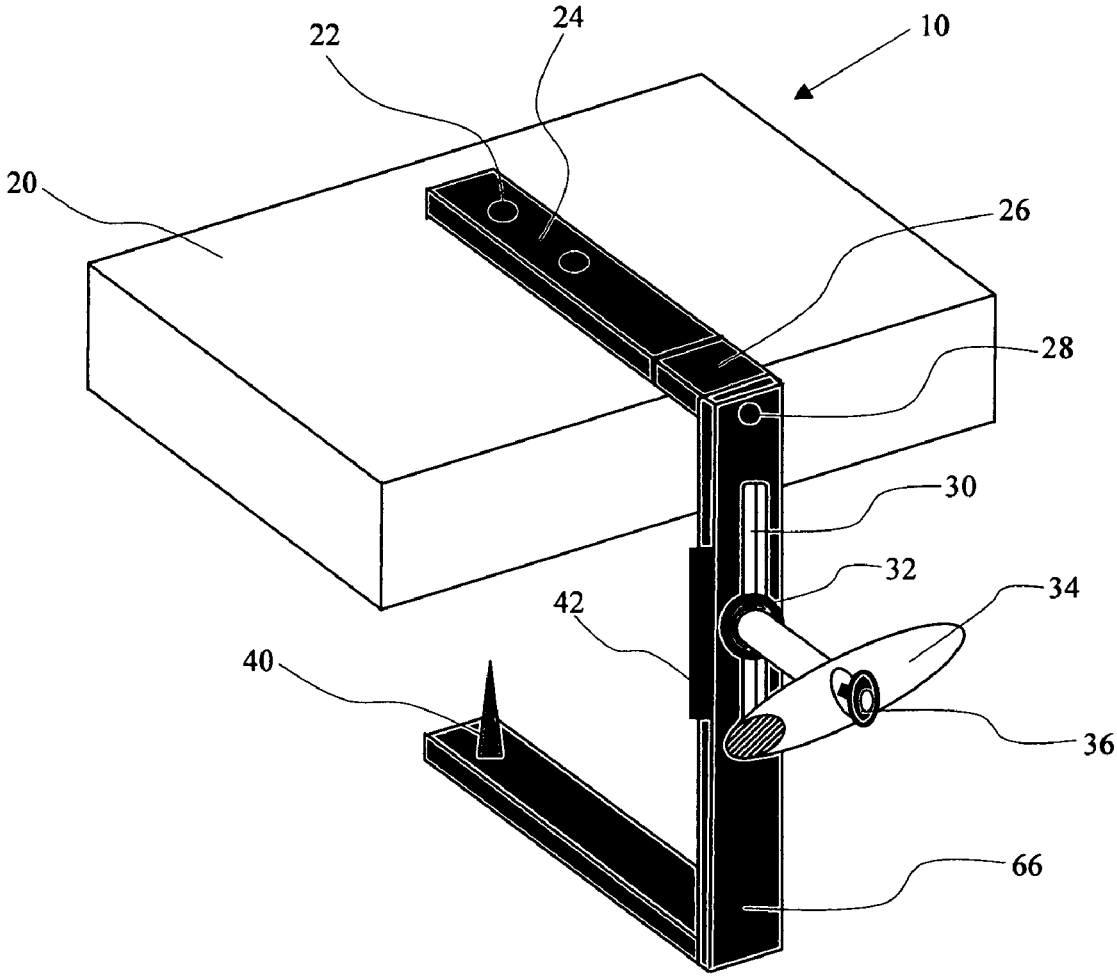
FIG. 1 is a perspective view of an embodiment of the invention in its fully assembled form.

As illustrated in FIG. 1, in a embodiment, The Multi-use Portable Lock System 10 comprises a removable cover 20 supported and pressed down by a cover arm 24 which is attached by conventional means 22. The cover arm 24 is inserted into a arm holder 26 which is attached to a first extended arm 62 by conventional means 28. The system 10 is further comprised of a rotating user handle 34 which can be locked by a conventional key 36. The rotating user handle 34 is attached to interior locking mechanism, which will be described later, through a built in groove 30, a rotating cylinder 58 and a conventional washer 32. A arm guide 42 is attached to the first and a second extended arm 62 and 66. A conic pin 40 is attached to the bottom limb 81 facing towards the bottom of the desk.

Figure 3:
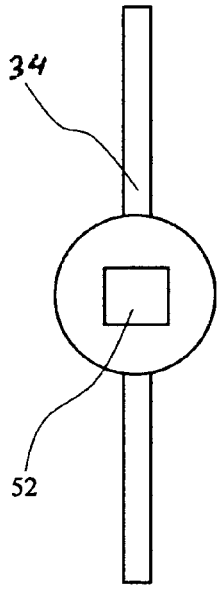
FIG. 3 is a front view of the handle, which shows a square opening in middle.
Figure 2:
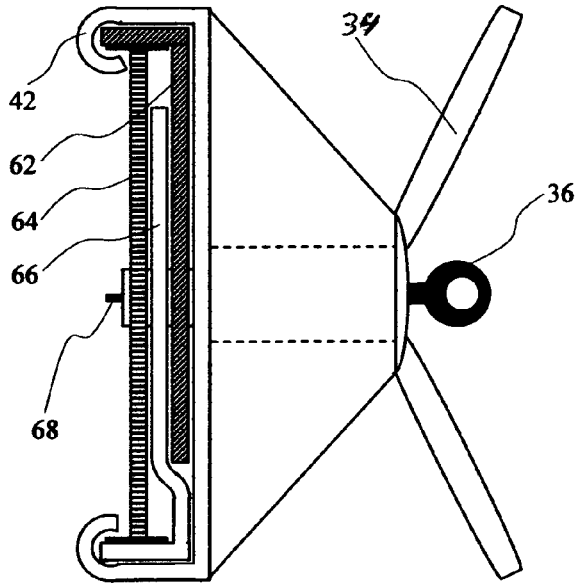
FIG. 2 is a cross-sectional view of a handle, including a lock, a cylinder body, a first and a second extended arm, including a first and a second rail, respectively, and a internal rotating gear contacting the first and second rails, and connected to the handle through the cylinder body.
Figure 4:
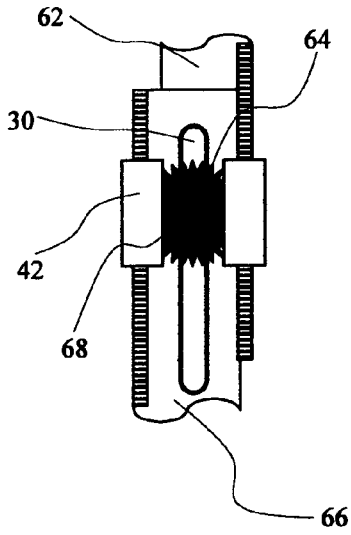
FIG. 4 is a front view of the first and second extended arms, including respective first and second rails, contacting the internal rotating gear.

FIGS. 2, 3 and 4 present sectional views of an interior locking mechanism. The rotating user handle 34, with a built-in square shaped opening 52 provide ability to rotate an internal rotating gear 64. The rotating user handle 34 can be locked, from rotating, by the conventional key 36. The rotating user handle 34 is attached to the internal rotating gear 64 through the built-in groove 30 and the rotating cylinder 58. The locking mechanism is further comprised of the arm guide 42, the first and second extended arm 62 and 66 which are attached to, the internal rotating gear 64 by a first and second built-in rail, respectively, and a Hook 68.

Figure 6:
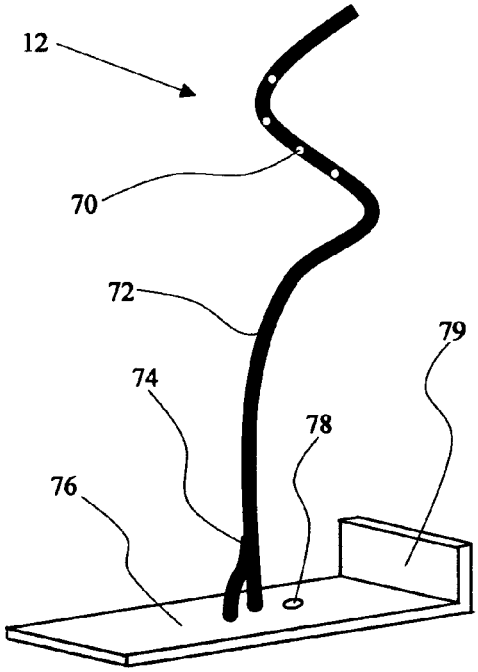
FIG. 6 is a perspective view of an adjusting assembly, including an interior base plate and a adjustable string, which connects with the embodiment of FIG. 5.
Figure 5:
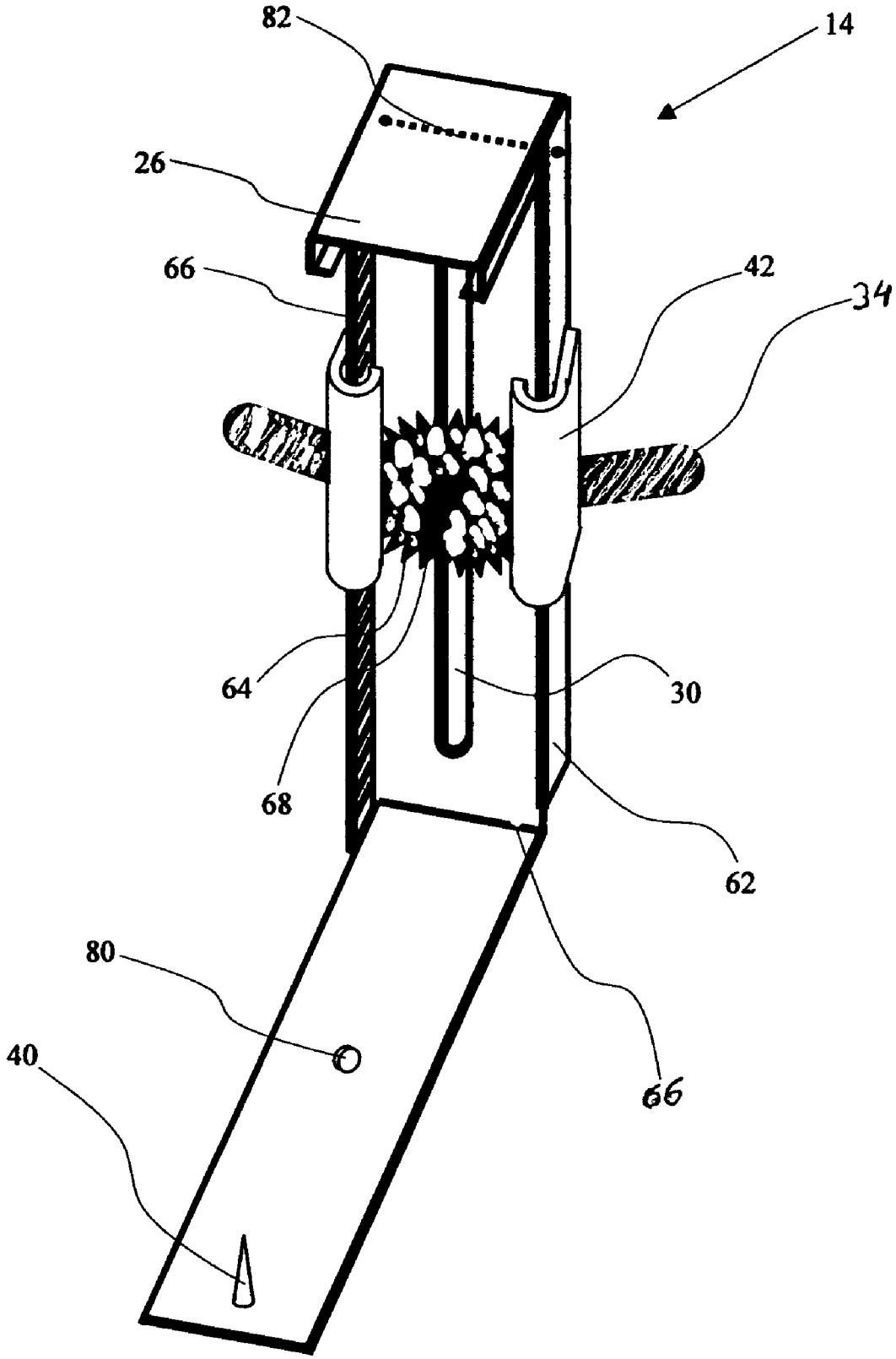
FIG. 5 is a perspective view of another embodiment of the multi-use portable locking system.

Referring to FIG. 5, in an embodiment of the invention, The Multi-use Portable Lock System 14 comprises the arm holder 26 which is attached to the first extended arm 62. A horizontal support pin 82 is located internally inside the arm holder 26. A adjustable string 72, best shown in FIG. 6, is pulled from step 79 to the arm holder 26, and over the horizontal support pin 82 and tied to a hook 68. The rotating handle 34 attached to the internal rotating gear 64 via built-in groove 30. The system 14 further comprises the arm guide 42 which is connected to the handle 34. The first and second extended arms 62 and 66 are attached to the internal rotating gear 64 by the first and second built-in rail, respectively. The Hook 68 is conveniently located, faced down, on the internal rotating gear 64. The bottom limb 81 has a hole 80, and the conic pin 40 is facing up towards the arm holder 26.

FIG. 6 illustrates a perspective view of an adjusting assembly 12, which works in conjunction with The Multi-use Portable Lock System 14. The adjusting assembly 12 is comprised of an interior base plate 76 and an adjustable string 72. The interior base plate is comprised of a step 79 and a hole 78. The adjustable string 72 includes a plurality of built-in holes 70 and a conventional security pin 74 connecting said adjustable string 72 to the interior base plate 76.

Figure 7:
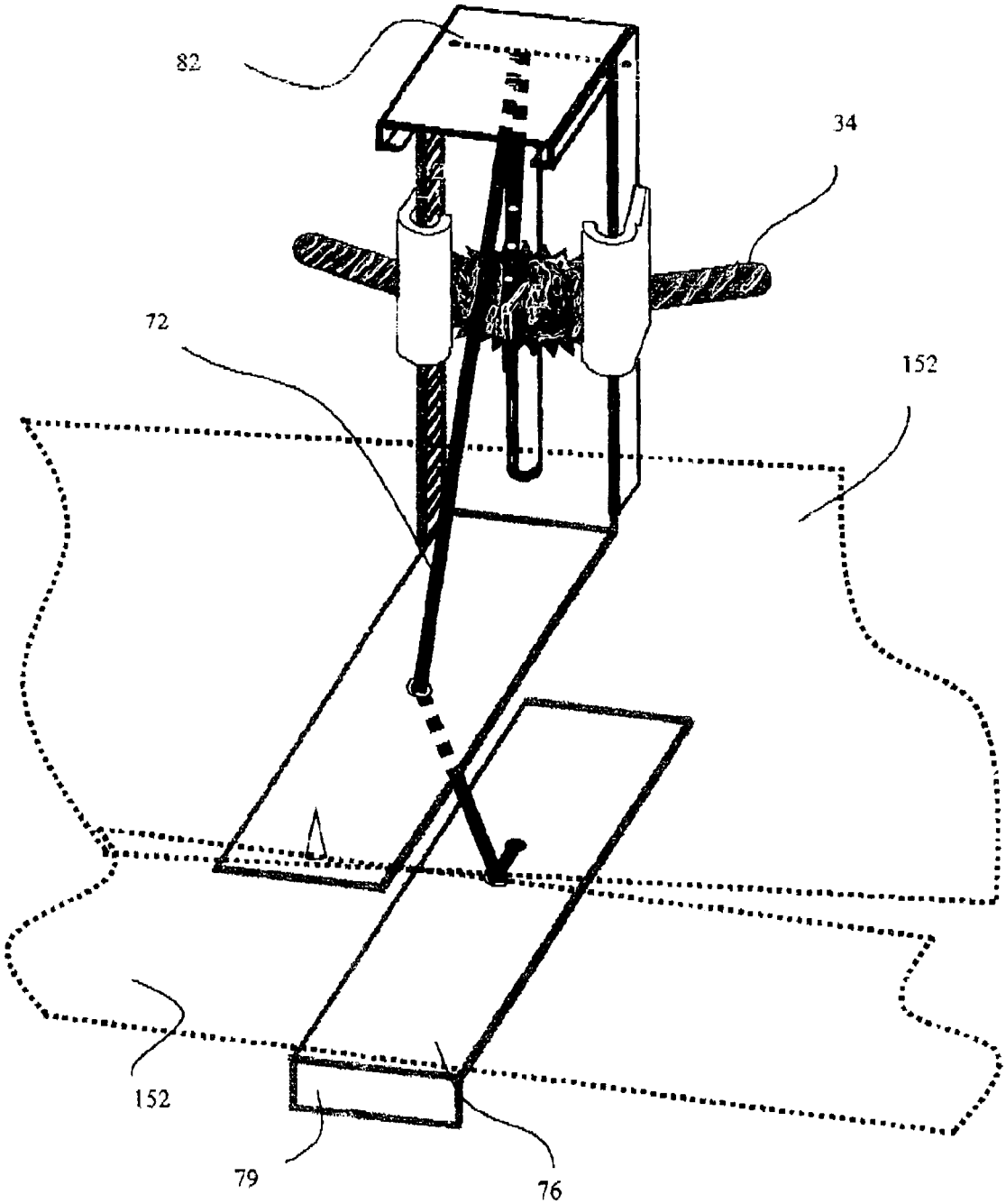
FIG. 7 is a perspective view of the embodiment of FIG. 5 and the interior support place and the adjustable string, connected, to secure a pair of doors.

FIG. 7 illustrates another embodiment of the invention that encompasses The Multi-use Portable Lock System 14 and the adjusting assembly 12. The system 14 is connected with the adjusting assembly 12. The interior base plate 76 and the adjustable string 72 work in conjunction and illustrate how two plates, such as doors or the like can be locked by placing the system 14 externally to the two plates and connecting the system 12 internally. The adjusting string 72 is inserted through the hole in the square plate 78, and is connected to the horizontal support pin 82, and connected to the hook 68, providing the ability to secure a pair of doors.

Figure 8:
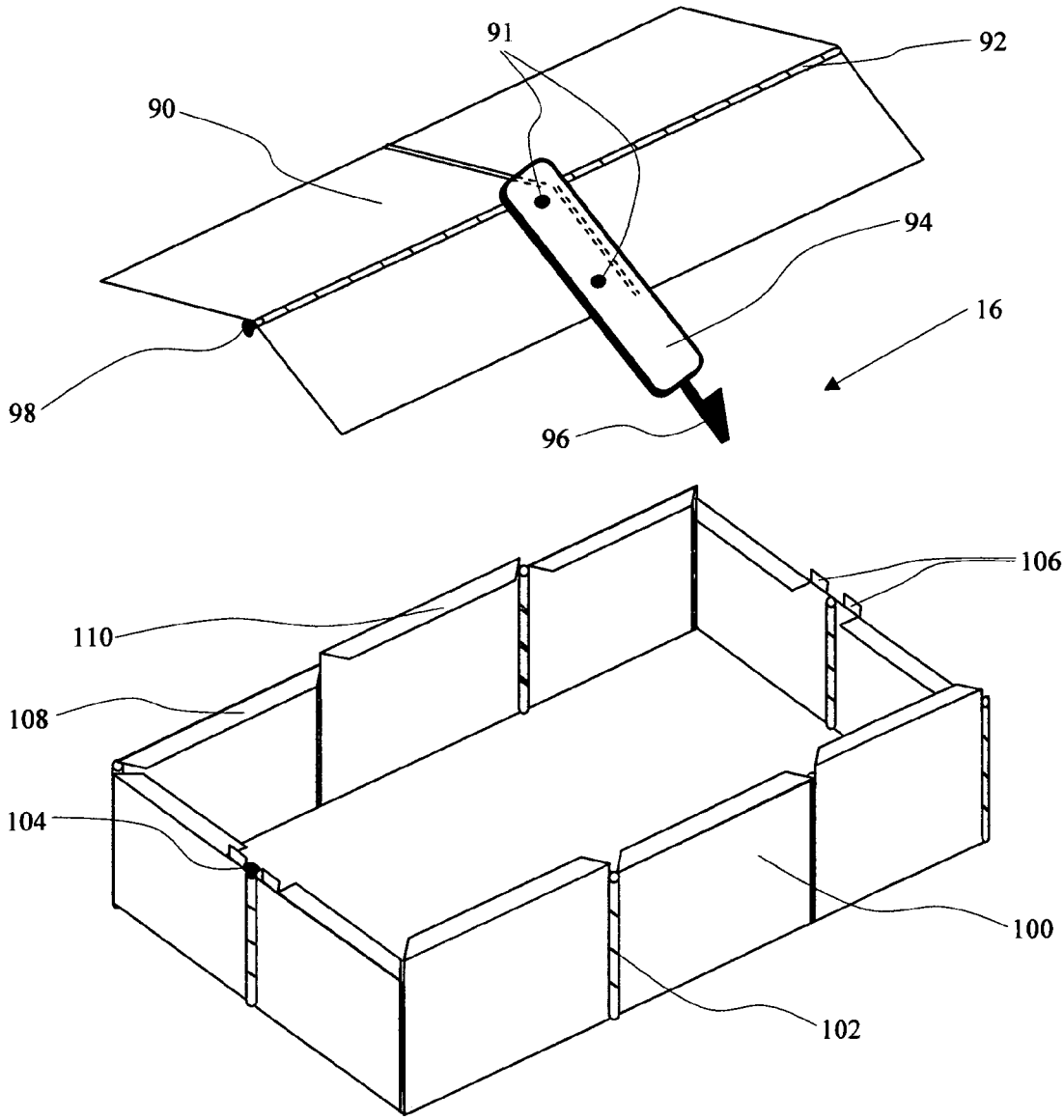
FIG. 8 is a perspective view of a frame and a foldable cover, including a manual latch.
Figure 9:
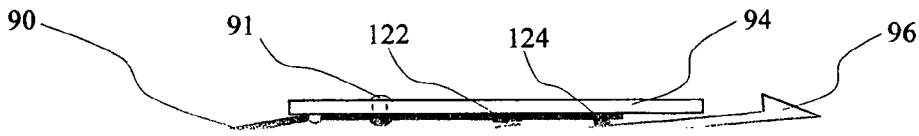
FIG. 9 is a perspective view of the manual latch in detail.

FIGS. 8 and 9, present a foldable cover 16, used in an embodiment of the invention. The foldable cover 16 comprises a foldable top 90, a hinge 92 including a security pin 98. A cover top arm 94 is attached to the top 90 by conventional means 91. A horizontal "V" shaped spring based latch 96, best shown in FIG. 9, is attached to the cover arm 94 by conventional means 124, which connects spring based latch 96 and top arm 94 and provides flexible movement to the latch 96.

The spring based latch 96 is sticking out to provide locking ability between the foldable cover 16 and the horizontal support pin 82 of the arm holder 26 of an embodiment. Latch 96 is pushed up by a spring 122, best shown in FIG. 9, which provides the user an ability to unlock it by manually pressing the edge of latch 96 which is located inside the foldable cover 16. A foldable frame 100 comprises a plural number of hinges 102 and a unfolding security pin 104. The Foldable frame 100 further comprises a plurality of cover stoppers 106, cover bottom supports 108 and top supports 110.

Figure 10:
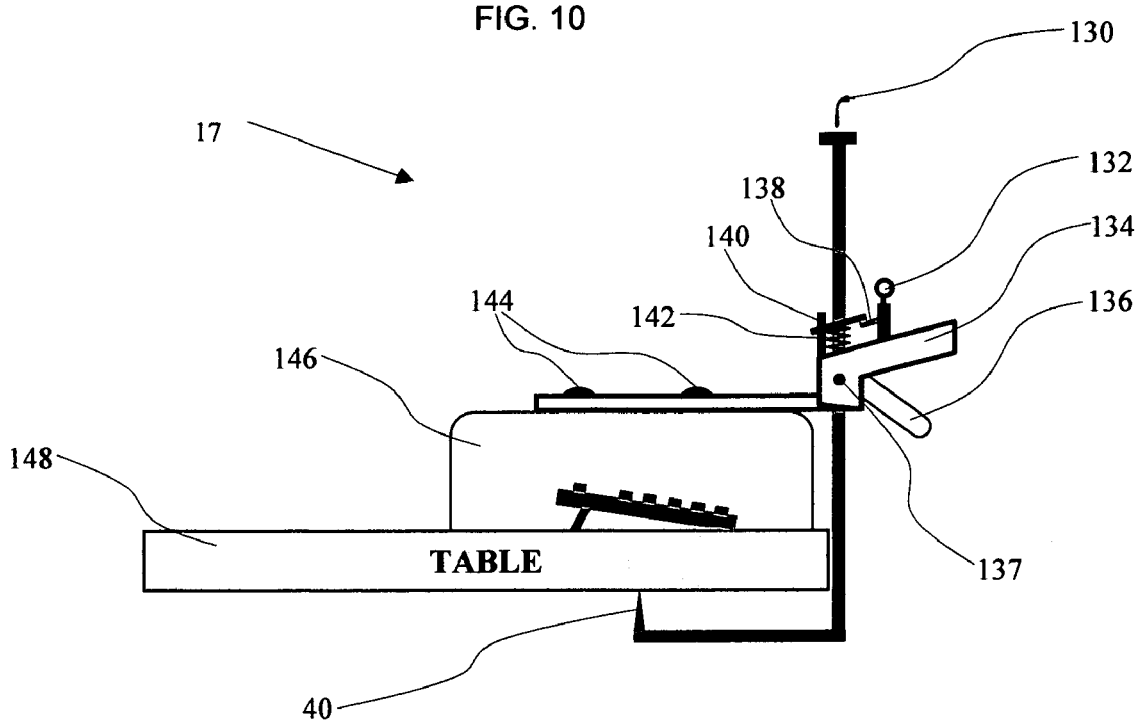
FIG. 10 is a side view of another embodiment of the invention, in its fully assembled form shown in its locked position.

Referring to FIG. 10, in another embodiment of the invention, the Multi-use Portable Lock System 17 comprises a arm 130, which ends with the conic pin 40 facing towards the back of the desk, a locking assembly, including a locking key 132, a handle 134 and a pivotally rotating trigger 136 connected to the handle 134 by conventional means 137. The System 17 is further comprised of a locking pin 138 a arm pusher 140 and a spring 142. A top cover 146 covers valuable particles located on top of a desk 148, and is connected to the main body of system 17 by conventional means 144.

Referring to FIG. 1, in a method for the use, in accordance with the multi-use portable lock system 10 enables a user to lock valuable personal items, like computer keyboard, phone, answering machine, notebook and the like located on top of the desk without prior preparation and damaging the desk after the usage. The system 10 comprises a cover 20, which will be placed on top of the desk particles to be secured after it will be fully assembled with first and second extended arms 62 and 66. The cover 20 is connected by conventional means 22 to, and pressed down by, the cover arm 24. The pressure on the cover arm 24 is caused by the fact that when a user rotates the user rotating handle 34 it rotates the internal rotating gear 64, best shown in FIG. 6, which is connected to the handle 34 via built-in through groove 30, the internal rotating gear 64 in turn, moves, and is connected to, and results in, the first extended arm 62 moving down and the second extended arm 66 moving upward until the multi-use portable system 10 is tightly secured on the desk. The conic pin 40, located the bottom limb 81 connected to the second extended arm left 66, is tacked to the bottom side of the desk top when the device is in its fully tight position after which the whole system is key locked by using conventional means.

In another embodiment, the multi-use portable locking system allows a user to lock closet doors, washing machine doors and the like by the use of the adjusting assembly 12, best shown in FIG. 7, inside the items required to be locked, then closing the door or doors 152 and rotating the handle 34 until the adjustable string 72, connected to the horizontal support pin 82 and to hook 68, is tight, securing the doors. The system is secured by the key 36 which removed from the system for security reasons. At that times the doors are locked and fully secured.

FIGS. 8 and 9 illustrate, in a method for the use of the present invention. The foldable cover 16 provides optional foldable frame 100, structured with multiple pieces connected by the hinges 102 between them, pulling out the security pin 104 will enable the user to fold the frame 100 in a "hand fan" manner for storage and traveling purposes. System further comprises the foldable top 90 which also built with multiple pieces that can be easily folded by pulling pin 98 out. The top 90 inserted on top of fully formed frame 100 one side at a time placing the top 90 on top of covert support 108, but beneath top supports 110 which preventing from the top 90 to slide to the sides and lifted up, while stoppers 106 preventing from top 90 to slide out.

The cover top arm 94 is attached to the top 90 by conventional means 91. Spring based latch 96, best shown in FIG. 9, is attached to the bottom of the cover arm 94 by conventional means 124, which provides vertical movement to latch 96. Latch 96 is needed in order to connect the foldable cover to system 16 to The Multi-use Portable System 14, best shown in FIG. 5, by locking it into the horizontal support pin 82. When the system 14 is tightened and locked user doesn't have access to release latch 96, which has tendency to be lifted up by the built-in string 122.

FIG. 6, in a method for the use of an embodiment in accordance with the present invention, the adjusting assembly 12 provides the interior base plate 76 enables the user to place it inside of the door and then connect the adjustable string 72 to system 14 while it's in a minimum space between the first and second extended arms 66 and 62, best shown in FIGS. 5 and 7, by inserting it through the horizontal support pin 82 and then placing one of the holes 70 on top of hook 68 in a tight manner. The adjusting assembly 12 is placed internally behind the door with step 79 up or down depends on the interior surface between the door and the body. When the interior surfaces are equal then a flat area, of the adjusting assembly 12, will be used. In order to use the flat area of the adjusting assembly 12 the string 72 must be inserted into hole 78, so step 79 it will be facing downwards.

Referring to FIGS. 5 and 7, in a method for the use of an embodiment in accordance with the present invention, The Multi-use Portable Lock System 14 and adjusting assembly 12 enables the user to lock doors. System 14 includes an arm guide 42, built as one piece, which their main purpose is to hold together the first and second extended arm 66, and 62 and the handle 34. Arm guide 42 built in such a way that prevent from all the pieces to be separated. The adjusting assembly 12 attached with a flat area to the interior of the locking doors while string 72 goes through hole 80 then through horizontal support pin 82 hooked onto hook 68, and then it can be tightened by rotating the handle 34 and the whole system can be locked by the key.

FIG. 10, in a method for the use of another embodiment in accordance with the present invention, The multi-use Portable System 17 enables the user to lock valuables on top of the desk by pulling the trigger 136, and while holding it, the user needs to pull up the arm 130. Safety cover 146 is placed on top of the valuable particle required to be locked while sharp end of conic pin 40 is attached to the back side of the desk top plate then while holding the handle 134 the user repeatedly squeezes trigger 136, as in "calking gun" method, causing the arm pusher 140 to press forward, until the safety cover 146 contacts the top of the desk. The system is secured by the key 132 which moves locking latch 138 under, and prevents the arm pusher 140 from moving. The key 132 is removed from the system, for security reasons, releasing the arm pusher 140.

In accordance with the present invention, the particular embodiments are capable of providing a multi purpose portable locker for enabling a user safe, efficient, and practical lock of valuable particles placed on the desk as well as locking doors like closet, kitchen cabinets and the like. The system is foldable for storage and traveling purposes. However, other embodiments of the present invention may be utilized without departing from the spirit and the scope of the invention. Based on the present disclosure, other constructions and applications are known to one skilled in the art.

In view of the above, it is apparent that the system and method of the preferred embodiments of the present invention enhance substantially the practicality and effectiveness of enabling a user to lock valuable particles temporarily placed on the desk. The system and the method further enable the user to lock doors such as closets, kitchen cabinets and the like.

While the present invention has been described in connection with the specific embodiments identified herein, it will be apparent to those skilled in the art that many alternatives, modifications and variations are possible in light of the above description. Accordingly, the invention is intended to embrace all such alternatives, modifications and variations as may fall within the spirit and scope of the invention disclosed herein.

What is claimed is:

1. A multi-use portable lock system, enabling a user to secure valuables, and to lock doors, such as bedroom doors, closet sliding doors, kitchen cabinet doors, washer and dryer doors, said system comprising:

a first and a second extended arm, including a respective first and second rail;

a handle, including a key and lock, connected to an internal rotating gear through a cylinder body, said rotating gear within said first and second extended arms, contacting said first and second rails of said first and second extended arms;

an arm guide, holding said first and second extended arms;

a foldable cover, securing valuable particles, said cover contacting a cover arm, said cover arm including a top arm, a spring and a manual latch, said top arm contacting an arm holder when said manual latch contacts a horizontal support pin within said arm holder, said spring retracting, contacting said arm holder to said cover arm, said arm holder contacting said first extended arm;

a bottom limb attached to said second extended arm, said bottom limb including a conic pin; and an adjusting assembly, said adjusting assembly including an interior base plate and an adjustable string, said interior base plate including a first hole and a step, said adjustable string including a plurality of built in holes or grooves, secured to said interior base plate by a security pin, wherein said adjustable string pierces said first hole of said interior base plate and a second hole of said bottom limb, contacting said horizontal support pin, and said plurality of built in holes or grooves of said adjustable string contacting a hook.

* * * * *